US008133048B2

(12) United States Patent
Stricker et al.

(10) Patent No.: US 8,133,048 B2
(45) Date of Patent: Mar. 13, 2012

(54) METHOD AND BLANK FOR PRODUCING A SCREW-TUBE CONVEYOR AND SCREW-TUBE CONVEYOR PRODUCED IN THIS WAY

(75) Inventors: Urban Stricker, Hilchenbach-Vormwald (DE); Frank Woelfle, Bonn (DE)

(73) Assignee: Stricker-IRD Patent GMR, Hilchenbach (DE)

( * ) Notice: Subject to any disclaimer, the term of this patent is extended or adjusted under 35 U.S.C. 154(b) by 404 days.

(21) Appl. No.: 12/440,473

(22) PCT Filed: Aug. 2, 2007

(86) PCT No.: PCT/EP2007/006842

§ 371 (c)(1),
(2), (4) Date: Mar. 9, 2009

(87) PCT Pub. No.: WO2008/031478

PCT Pub. Date: Mar. 20, 2008

(65) Prior Publication Data

US 2010/0038211 A1 Feb. 18, 2010

(30) Foreign Application Priority Data

Sep. 13, 2006 (DE) ..... 10 2006 042 856

(51) Int. Cl.
*B21C 37/26* (2006.01)

(52) U.S. Cl. ..... 425/208; 198/657

(58) Field of Classification Search ..... 198/550.6, 198/625, 657; 425/208, 376.1; 366/89
See application file for complete search history.

(56) References Cited

U.S. PATENT DOCUMENTS

| | | | | | |
|---|---|---|---|---|---|
| 3,912,241 | A | * | 10/1975 | Oestreich | 366/99 |
| 5,071,256 | A | * | 12/1991 | Smith et al. | 366/89 |
| 5,516,206 | A | * | 5/1996 | Seide et al. | 366/76.7 |
| 5,984,516 | A | * | 11/1999 | Inoue et al. | 366/97 |
| 6,094,795 | A | * | 8/2000 | Davenport | 29/407.1 |
| 7,628,890 | B2 | * | 12/2009 | Chupka et al. | 162/261 |
| 7,811,075 | B2 | * | 10/2010 | Shimada | 425/208 |

FOREIGN PATENT DOCUMENTS

| | | |
|---|---|---|
| DE | 2352609 | 4/1974 |
| DE | 3216960 | 1/1994 |
| GB | 853574 | 11/1960 |
| GB | 1354781 | 5/1974 |
| JP | 60024221 | 2/1985 |
| TW | 039466 | 11/1990 |

* cited by examiner

*Primary Examiner* — Douglas Hess
(74) *Attorney, Agent, or Firm* — Andrew Wilford

(57) ABSTRACT

The invention relates to a method and a blank for producing a screw-tube conveyor in the form of a cylindrical rotary tube (110) with an internal screw spiral (120) for conveying and mixing a bulk material. To simplify the method and to create even long screw-tube conveyors with small diameters in an relation to their length, it is proposed according to the invention first to produce a one-piece blank, which comprises a base portion in the basic form of a parallelogram and having laterally mounted fins. In a second method step, the fins are then bent, preferably by 90°, with respect to the base portion. In a third method step, the base portion (112) is then bent along bending lines (115$_i$) in such a way that the base portion forms a helical casing portion (111) of the rotary tube (110) and the previously bent-round fins (122) form segments of the screw spiral (120) arranged inside the rotary tube (110). The invention also relates to a screw-tube conveyor produced in this way.

22 Claims, 4 Drawing Sheets

METHOD AND BLANK FOR PRODUCING A SCREW-TUBE CONVEYOR AND SCREW-TUBE CONVEYOR PRODUCED IN THIS WAY

CROSS REFERENCE TO RELATED APPLICATIONS

This application is the US national stage of PCT application PCT/EP2007/006842, filed 2 Aug. 2007, published 20 Mar. 2008 as WO2008/031478, and claiming the priority of German patent application 102006042856.0 itself filed 13 Sep. 2006, whose entire disclosures are herewith incorporated by reference.

FIELD OF THE INVENTION

The invention relates to two alternative methods and blanks for making a screw-tube conveyor in the shape of a cylindrical rotatable tube with an internal helix for conveying and mixing bulk material, particularly in the sectors of the pharmaceutical industry or in the food industry.

BACKGROUND OF THE INVENTION

Screw-tube conveyors are generally known according to prior art, and defined, for example, in DIN 15 201. In addition to continuous conveyance of bulk material, screw-tube conveyors always also serve for mixing same; in many cases they may also serve for the surface treatment, for surface coating, or for the thermal treatment of the bulk material. Contrary to so-called screw conveyors, which are not an object of the invention, screw-tube conveyors are not very efficient solely for conveying bulk material.

In the traditional manufacture of a screw-tube conveyor a helix is attached to the interior of a cylindrical rotatable tube, for example, welded, soldered, etc., in that persons, or welders crawl into the screw-tube conveyor and carry out the attachment work at the seam between the rotatable tube and the helix.

The length of the attachment zone between the rotatable tube and the helix is many times longer than the total length of the screw-tube conveyor. Traditionally, the attachment zone is formed by a very long weld seam, optionally on two sides, which represents a substantial cost factor in the manufacture of the screw-tube conveyor.

In order to make such attachment even possible, both the exterior diameter and the clear interior diameter of the rotatable tube must have certain minimum values. For this purpose the clear interior diameter of the rotatable tube is determined by the height, or depth of the helixes. The screw pitch may also not be too small so that access to the attachment zone is ensured between the rotatable tube and the helix.

OBJECT OF THE INVENTION

Starting from this state of the art, the object of the invention is to provide a blank for making a screw-tube conveyor that very significantly reduces both the time and the cost for the manufacture of the screw-tube conveyor during its manufacture.

SUMMARY OF THE INVENTION

In a first embodiment the method is characterized by the following steps:

a) providing a unitary blank in the form of a generally parallelogrammatic base strip having at least one transversely extending fin, the generally parallelogrammatic base strip having first and second pairs of parallel edges that are each positioned opposite each other, bend lines being provided between the second pair of edges extending parallel thereto, the fin being formed unitarily with the base strip on at least one of the edges of the first pair between two adjacent bend lines or between one of the edges of the second pair and the adjacent bend line;

b) bending the fin about a fin bend angle $\gamma$ relative to the base strip along the edge at which the fin is unitarily connected to the base strip; and c) bending of the base strip along the bend lines about a base bend angle $\delta$ such that the base strip forms a helical row of polygonal base zones of the rotatable tube and the previously bent fins form segment of the helix inside the rotatable tube.

Due to the inventive unitary formation of the blank in the form of a base strip that is in the form of a parallelogram, having integral that are later bent as segments of the helix, a form-fitting transition is ensured between the interior of the rotatable tube and the helix in a first embodiment, without requiring any mounting work for making the connection between the rotatable tube and the helix inside the screw-tube conveyor, with the exception of the bending of the fins. Because of the bending of the fins relative to the base strip a transition free of any recesses is created between the cylindrical rotatable tube and the helix such that advantageously no bulk material can be trapped therebetween.

In a second embodiment the above stated object is solved by the method characterized by the following steps:

a) providing a unitary blank comprising a base strip 112' shaped as a convex rectangle, preferably a parallelogram, having at least one lateral fin, the generally parallelogrammatic base strip having a first and a second pair of basically parallel edges positioned opposite of each other, bend lines being provided on the base strip between the second pair of edges and extending parallel thereto, the at least one fin being formed unitarily with the base strip on at least one of the edges of the first pair between two adjacent bend lines or between one of the edges of the second pair and an adjacent bend line;

b) bending the fins about a fin bend angle $\gamma'$ relative to the base strip along the edge at which the fin is unitarily connected to the base strip;

c) bending of the base strip along the bend lines about a base bend angle $\delta'$ such that the base strip forms a row of helical base zones of the rotatable tube and the previously bent fin forms a ridge on the helical row of base zones that protrudes radially outward;

d) interleaving the helical row of base zones and a helical strip into the screw-tube conveyor such that the ridge engages the helical strip at an outer edge thereof and that part of the helical strip that is not covered by the ridge forms the helix inside the screw-tube conveyor; and e) joining the helical strip and the ridge in the overlapping regions into the screw-tube conveyor.

Both inventive methods for making the screw-tube conveyor by bending the fins and bending the base strips advantageously also enable the manufacture of relatively long screw-tube conveyors, having relatively small clear diameters, because, as mentioned, mounting work is no longer required inside the screw-tube conveyor for connecting the helix to the rotatable tube.

Because the screw-tube conveyor is produced across a desired total length by both methods, so that individual channels or longitudinal sections are merely joined together by spot welding, the risk of deformation—relative to the screw-tube conveyors traditionally produced using a helical welding seam—is advantageously significantly lower in the screw-tube conveyors produced in the manner.

The screw-tube conveyor produced according to both methods comprises a rotatable tube of polygonal cross section due to the multiple bends between the base zones. This provides the advantage that mixing of the bulk material is significantly improved during rotation of the screw-tube conveyor, relative to a rotatable tube having a circular cross-section. In particular, the mounting of additional mixing elements, such as blades, paddles, ploughs, can advantageously be omitted.

In both embodiments of the method a V-shaped cut having an opening angle $\alpha$ of between 0° and 180° is provided at the base strip between two adjacent fins.

Depending on whether a base bend angle $\delta$, by which the base strip is bent along a bend line, is smaller, equal to, or larger than the opening angle $\alpha$, the following configurations are created inside the rotatable tube in the first embodiment: if the base bend angle $\delta$ is equal to the opening angle $\alpha$, two adjacent fins in the screw-tube conveyor produced according to the method are at a "mitered joint" and there is no overlapping of the two adjacent fins. If the base bend angle $\delta$ is smaller than the opening angle $\alpha$, a V-shaped cutout, or an intermediate space is formed the two adjacent fins. The intermediate space mentioned has the advantage that bulk material may pass from one turn over into an adjacent turn of the screw-tube conveyor, thus achieve an improved mixing of the bulk material. If the base bend angle $\delta$ is larger than the opening angle, the two adjacent fins overlap along the bend lines after bending.

The opening angle $\alpha$ is required in the second embodiment in order to enable bending of the base strip so that the fins protrude radially outward.

The fin bend angle $\gamma$ is preferably 90° in both embodiments; in this case the helix is perpendicular to the respective base zone of the rotatable tube inside the screw-tube conveyor.

Advantageously the material is punched to produce the blank in both embodiments, cut using a laser beam, or milled.

The object mentioned above is further solved by a blank for making the screw-tube conveyor. The advantages of the blank substantially correspond to the advantages mentioned above with regard to the method.

Furthermore, it is advantageous if the blank is shaped initially planar with the base strip and the fin(s).

It is further advantageous that sheet metal can be selected for the blank, and therefore also for the screw-tube conveyor, having a thickness of 0.3 to 3 mm. Such thin sheet metal may not be utilized for screw-tube conveyors produced in the traditional manner, because it does not withstand the high temperatures used when welding long seams. In screw-tube conveyors produced according to the method according to the invention, however, it is very usable, because long welding seams are not mandatorily necessary; the use of such thin sheet metal has the advantage that the thermal capacity of the screw-tube conveyor is low, and that the duration of thermal balancing effects between the bulk material and the screw-tube conveyor may therefore be held as short as possible at the start of a treatment process.

If multiple fins are formed on the same edge of the base strip, they may be immediately adjacent one another or spaced apart. If two fins are not adjacent each other this has the effect that an intermediate space remains between the two fins, even when the screw-tube conveyor is assembled. The intermediate space then has the same advantageous effect as the V-shaped intermediate space between two adjacent fins mentioned above, which is created if the base bend angle is smaller than the opening angle between the two fins.

In order for all adjacent fins or portions of the helix to abut at a "mitered joint," thus forming a helix without any intermediate space and without any overlapping, it is necessary that the opening angles $\alpha$ of the V-shaped cuts between two adjacent fins, and the two end-edge angles $\beta_1$ and $\beta_2$, which are each measured between the outer fins and the plum lines toward the edge of the base strip, are dimensioned such that $\alpha_{i+}\beta_1+\beta_2=360°$ and that, as mentioned above, the base bend angles $\delta_i$ are the same as the opening angles $\alpha_i$. If the sum of angles of $\alpha_{i+}\beta_1+\beta_2$ is smaller than 360° across a length of the base strip, which corresponds to the circumference of the rotatable tube, the adjacent fins are at least partially overlapped in the assembled screw-tube conveyor. In the other case, if the sum of angles is greater than 360°, intermediate spaces are created between adjacent fins.

The embodiment of the outer edges of the trapezoidal fins opposite of the base strip in the shape of a part-circular arc has the advantage that a tubular passage is formed to make a cylindrical passage in the screw-tube conveyor produced according to the invention, having a clear radius corresponding approximately to the radius of the part-circular arc.

In the method according to the invention the fins may be arranged on both longitudinal edges of the base strip opposite one another. After bending of the fins about the respective fin bend angle $\gamma$ and the subsequent bending of the base strip along the bend lines, the subsequently created helical portions of the screw-tube conveyor (turns) may be either directly adjacent, e.g. contacting each other, or at a distance to each other, depending on the embodiment of the base strip in the form of a parallelogram, e.g. depending on the intended increase for the screw-tube conveyor. If the turns of the screw-tube conveyor abutting one another directly in a suitable position, the previously bent fins of the individual channels also partially abut one another. In this case it is recommended to join the abutting bent fins, for example, by spot welds; in this manner the screw-tube conveyor is substantially stabilized. Contrary to prior art spot welding can be carried out at the edge of the passage, e.g. on the easily accessed outer edges of the fins; it is not necessary to do this on the less easily accessed joint between the rotatable tube and the helix.

The manufacture of screw-tube conveyors, even with a long total length, is substantially simplified in the two methods according to the invention in that individual (partial) longitudinal sections may be prefabricated, and later only have to be joined. The joining is carried out at the edge or connection points of two adjacent (partial) longitudinal sections, and is particularly simple if the individual longitudinal sections themselves are not too long (so that the connection point is accessible from the opposite end of the longitudinal section), and if the clear diameter or radius thereof is as large as possible.

Generally, the screw-tube conveyor may also be produced using a blank in the method according to the invention where the fins are formed merely at one of the edges of the parallelogrammatic base strip. In this case the thickness of the helix is merely the thickness of a single fin and not the thickness of two adjacent fins as in the previous case. Furthermore, it is then required that the turns of the rotatable tube formed by bending the base strip be joined by a helical weld seam. Although the base surface of the rotatable tube will be easy to access in this case, however, the manufacture of the welding seam is still more cost-intensive in this case due to the relatively long length of the welding seam, which is why the embodiment is merely suboptimal.

If it is desired that the rotatable tube produced according to the method according to the invention end on a plane at least at one of the two ends thereof, for example for mounting a flange, it is necessary that the two opposite edges of the first pair of edges be cut to taper at an acute angle to the end.

Finally, the above object is solved by a screw-tube conveyor. The screw-tube conveyor produced according to the method according to the invention and the blank according to the invention have the advantages mentioned above with regard to the method and the blank.

It is advantageous that the screw-tube conveyor may have one or multiple turns. In order to achieve a desired larger overall length, it is possible to prefabricate multiple longitudinal sections of the screw-tube conveyor using the method according to the invention and to then join the longitudinal sections into the screw-tube conveyor to make up the desired overall length.

It is advantageous if the screw-tube conveyor has a flange at least on one of the ends thereof, which is preferably mounted, i.e. welded on at the bent fins in the region of an end of the screw-tube conveyor. At one end of the screw-tube conveyor the flange may be embodied, for example, as a toothed gear that mesh with a pinion driven by a drive for rotating the screw-tube conveyor. On the other end thereof, optionally positioned in line with the toothed gear, a further flange may be provided formed as a support ring. In this case the support ring serves for rotational support of the screw-tube conveyor on rollers that are preferably a tapered. The frustoconical shape of the rollers serves for exerting axial pressure onto the screw-tube conveyor via an existing bearing.

It is finally advantageous if the screw-tube conveyor is coated, preferably enameled, on the interior, because in this case any narrow intermediate spaces or joint gaps possibly existing between two adjacent fins of the helix may be closed by the coating.

BRIEF DESCRIPTION OF THE DRAWING

Twelve figures relate to the description, in which.

DETAILED DESCRIPTION

The invention is explained in detail with reference the embodiments and the described figures. The same elements are denoted by the same reference symbols in the individual figures. A reference symbol without a prime refers to a first embodiment, while a reference symbol having a prime refers to a second embodiment for the method according to the invention for making a screw-tube conveyor.

FIGS. 1-7 refer to the first, and FIGS. 8-12] refer to the second embodiment of the invention.

Figure 1:
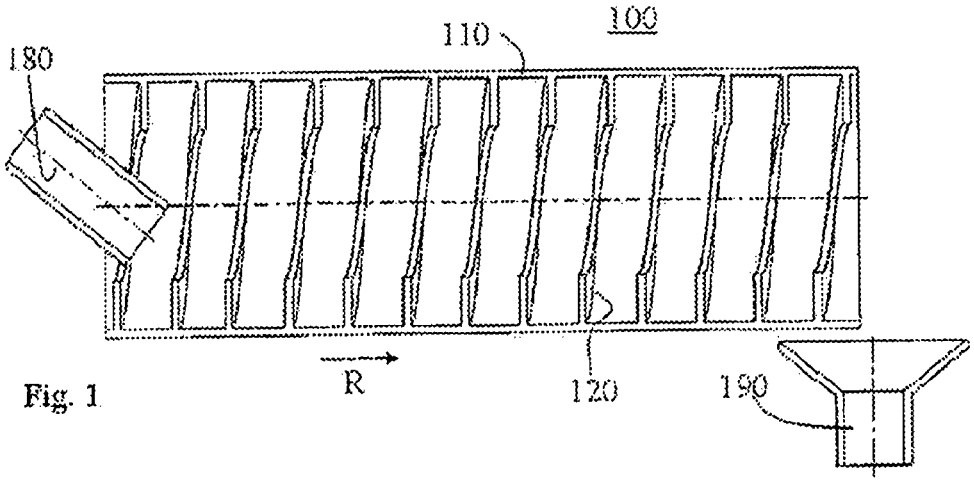
FIG. 1 shows a screw-tube conveyor produced according to the invention.

FIG. 1 illustrates a screw-tube conveyor 100 produced according to the method according to the invention. It comprises a cylindrical rotatable tube 110 having an internal helix 120 for conveying and mixing bulk material. The bulk material is fed into the screw-tube conveyor 100 via an inlet 180 at one end of the screw-tube conveyor, and exits it via an outlet 190 after it has been transported in the transport direction R by rotation of the screw-tube conveyor.

The method according to the invention for making the screw-tube conveyor shown in FIG. 1 is described in further detail below with reference to FIGS. 2 to 8.

A first step of the method according to the invention is provision of a unitary blank that is later formed into the screw-tube conveyor 100. The blank is preferably produced from a planar strip of sheet metal having a thickness of 0.3 to 0.8 mm, the sheet metal being stamped to the shape of the blank or being cut by a device such as a laser beam.

Figure 2:
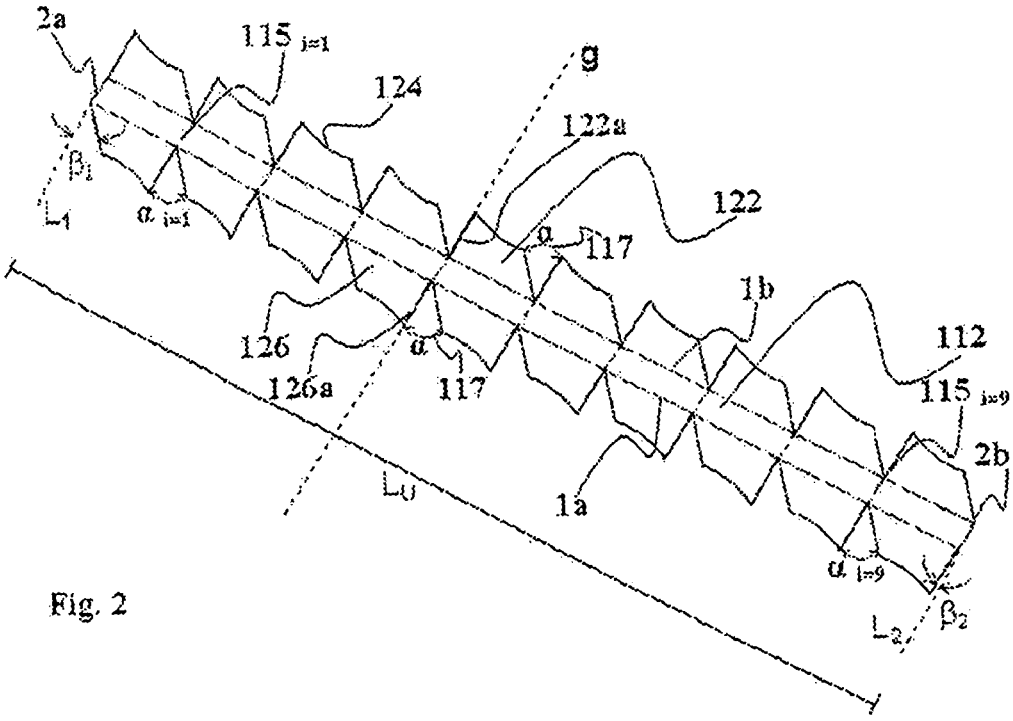
FIG. 2 shows a blank according to the invention for making a screw-tube conveyor according to a first embodiment.

As shown in FIG. 2, the blank for the method according to the invention consists of a parallelogrammatic base strip 112 having fins 122 that project transversely from it. Due to the parallelogrammatic shape, the base strip has a first pair of opposite longitudinal edges 1*a* and 1*b* and a second pair of opposite transverse end edges 2*a* and 2*b*. Bend lines 115 are formed on the base strip 112 between and extending parallel to the second pair of transverse end edges 2*a* and 2*b*. The unitary fins 122 projecting transversely from the base strip 112 are each unitarily formed with the base strip 112 between two adjacent bend lines or between one end edge 2*a* or 2*b* and the adjacent bend line $\mathbf{115}_{i-1}$, $\mathbf{115}_{i=9}$.

The fins 122 may be provided on both longitudinal edges 1*a* and 1*b* or only on one of the edges 1*a* or 1*b*. Furthermore, the fins 122 on one of the edges 1*a* of 1*b* may be provided immediately adjacent one another or longitudinally separated, that is not immediately adjacent one another. When two adjacent fins are provided on one of the edges 1*a* or 1*b*, a V-shaped slot 117 must be formed between them that flares from the respective bend line $\mathbf{115}_i$ and that separates two adjacent fins 122 from each other. The opening angle $\alpha$ between the two adjacent fins 122 may be between 0° and 180°. In FIG. 2 the fins are all shaped as trapezoids by way of example. The transverse edges 122*a* and 126*a* of alternate trapezoidal fins 122, 126 positioned at an offset opposite of the base strip 112 are on a straight perpendicular g. This gives the advantage that a cutting tool must be merely lifted to bypass the base strip for cutting the transverse edges 122*a*, 126*a*, but does not need be guided along a curve, thus simplifying manufacture of the blank.

Not all opening angles $\alpha_i$ of a blank have to be the same. This is also true for fin bend angles $\gamma_i$ and base bend angles $\delta_i$.

Figure 3:
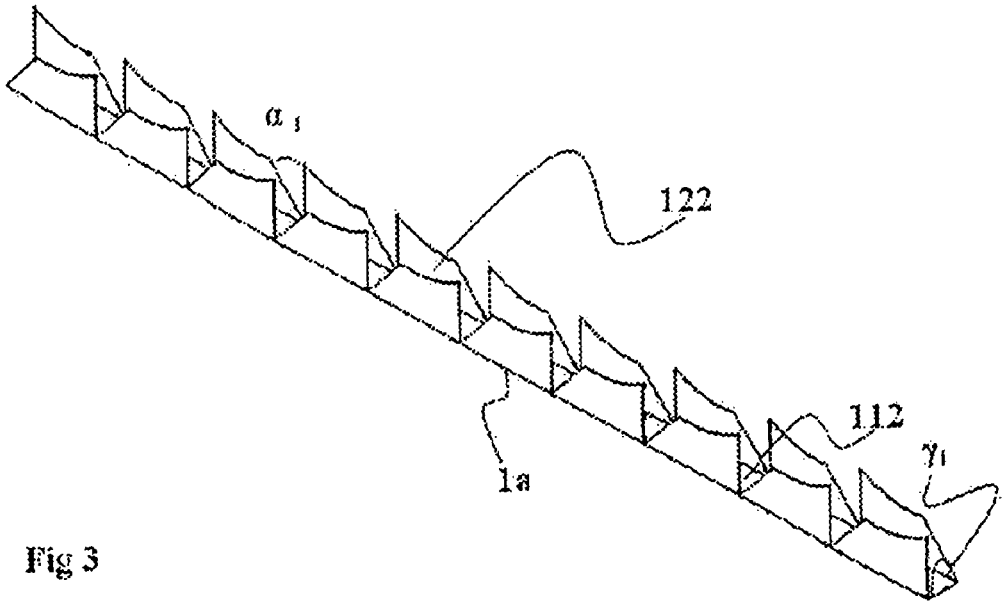
FIG. 3 shows a blank according to FIG. 2 having bent] fins.

After the first step of the method according to the invention described above, e.g. during manufacture of the blank shown in FIG. 2, the blank is processed in a second process step as shown in FIG. 3 such that the fins 122 are bent about the fin bend angles $\gamma$ relative to the base strip 112 along the edges 1*a* and 1*b* where each fin 122 is unitarily connected to the base strip 112. In this manner, the structure shown in FIG. 3 is created.

Finally, in a third process step the structure shown in FIG. 3, and more particularly the base strip 112, is bent along each of the bend lines $\mathbf{115}_i$ about the base bend angle $\delta_i$.

Figure 4:
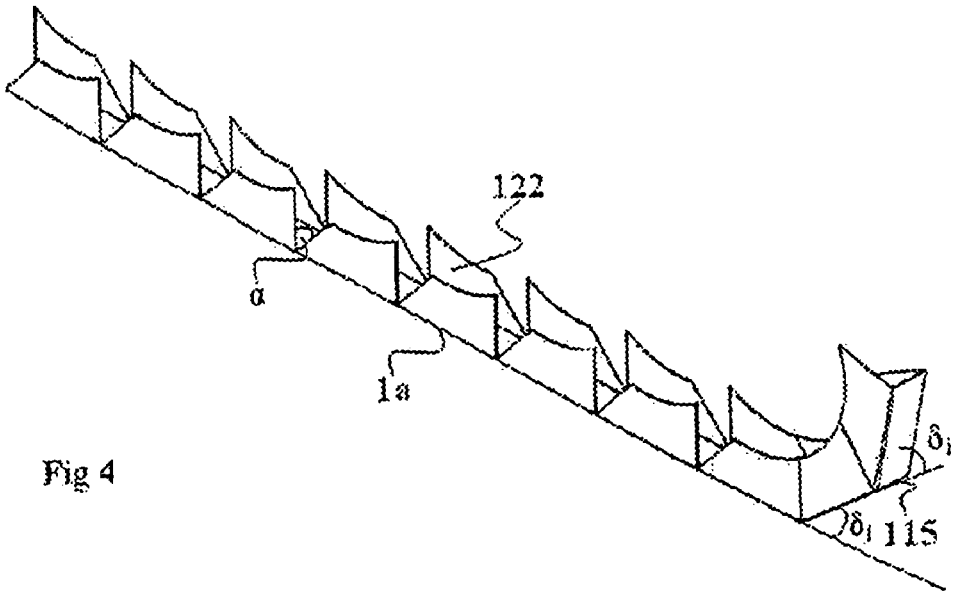
FIG. 4 shows a blank having fins bent according to the first embodiment, and having a partially bent base strip.
Figure 5:
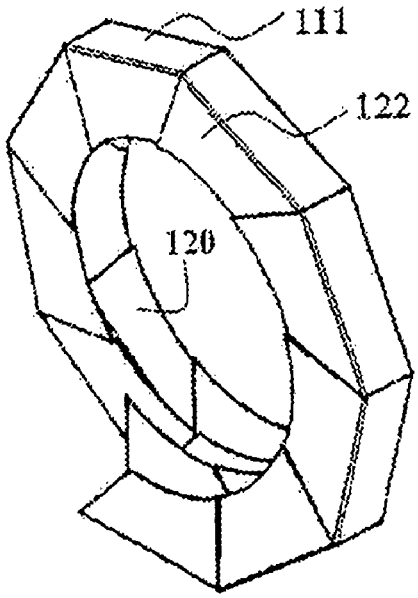
FIG. 5 shows a first turn of the screw-tube conveyor produced by bending the fins according to the invention, having an extension for a second turn, the fins in the region of the projection of the second turn and the adjacent fins of the first turn being spaced from one another.
Figure 6:
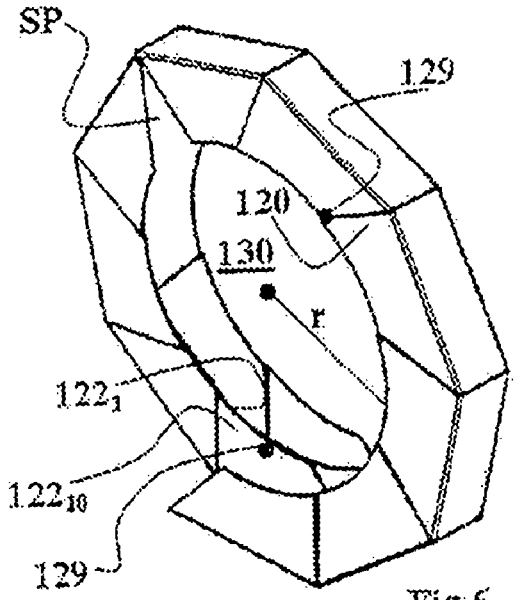
FIG. 6 shows a screw-tube conveyor according to FIG. 5, the fins of the projection of the second turn and the adjacent fins of the first turn being joined to one another by spot welds.

In FIG. 4 the base strip is initially bent only twice, while it is bent on all bend lines $\mathbf{115}_i$ in FIGS. 4 and 5. As shown in FIGS. 5 and 6 the original base strip 112 of the blank then forms a helical row of base zones 111 of the rotatable tube 110 and the previously bent fins 122 then form segments of the helix 120 formed inside the rotatable tube.

Figure 7:
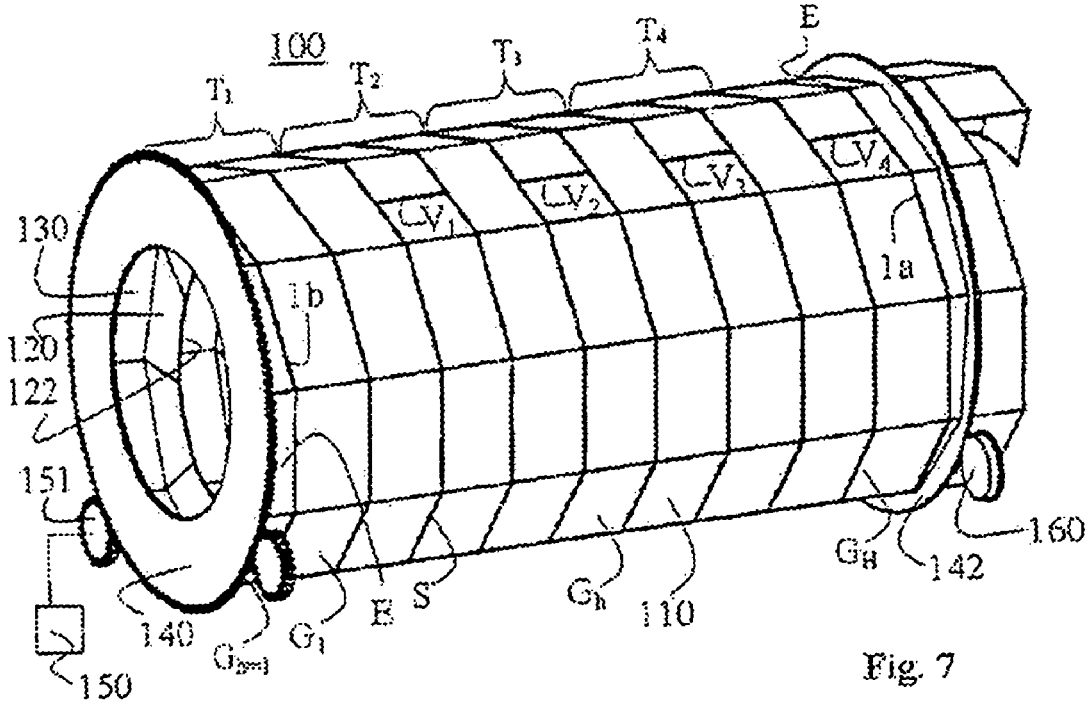
FIG. 7 shows a screw-tube conveyor produced according to the invention in accordance with the first embodiment, having flanges forming a pinion and a support ring.

It is obvious from FIGS. 5 to 7 that the base strip 112 must be formed in the form of a parallelogram if the screw-tube conveyor produced according to the invention is to have a pitch >0 as shown in FIGS. 5 to 7.

It is further obvious from FIGS. 5 and 6 that the individual adjacent and previously bent fins 122 are now arranged at a "mitered joint" next to each other, thus forming the helix 120. In order for the adjacent fins to be positioned at a "mitered joint" next to each other it is necessary that the individual base bend angles $\delta_i$ shown in FIGS. 3 and 4 be equal to the opening angles $\alpha$ of the V-shaped slots 117 between adjacent fins, also shown in the figures. As shown in FIG. 2, it is further required that adjacent fins 122 on the longitudinal edges 1*a* and 1*b* of the base strip 112 over a length $L_u$ corresponding to the circumference of the rotatable tube 110 meet the following requirements: the opening angles $\alpha_i$ with i=1-9 of the V-shaped slots 117 between two adjacent fins together with the two end-edge angles $\beta_1$ and $\beta_2$ must add up to 360°. For this purpose the end-edge angles $\beta_1$ and $\beta_2$ are each measured between the transverse edges of the outer fins and respective plumb lines $L_1$, $L_2$, which are perpendicular to the longitudinal edges 1*a* and 1*b* of the base strip.

If the sum of angles $\alpha_i+\beta_1+\beta_2$ is smaller than 360°, but the associated base bend angles $\delta_i$ at the bend lines $\mathbf{115}_i$ are larger than the respective opening angles $\alpha_i$, overlapping of two adjacent fins occurs during formation of the screw-tube conveyor (not shown).

As an alternative, a base bend angle $\delta_i$ may be smaller than an associated opening angle $\alpha_i$; this may then result in the fact that an intermediate space or a V-shaped gap remains between the two fins created during manufacture of the screw-tube conveyor. Bulk material may possibly pass through the gap, which may contribute to improved mixing of the bulk material. Such a gap is shown at reference symbol SP in FIG. 6.

If a cylindrical passage 130 as shown in FIG. 6 is desired inside the screw-tube conveyor, outer edges 124 of the trapezoid fins 122 positioned opposite of the base strip are cut as part-circular arcs. The position of each part-circular arc with regard to the base strip 112 and the radius r of each part-circular arc must be suitably selected. If the screw-tube conveyor has more than one turn, as shown in FIGS. 5 to 7, it is advantageous that fins $\mathbf{122}_{i=1}$, $\mathbf{122}_{i=10}$ extending parallel to and abutting one another be joined together. The joining is advantageously spot welds 129.

FIG. 7 shows a screw-tube conveyor produced according to the invention from outside. The screw-tube conveyor 100 shown consists of a row of longitudinally succeeding sections produced according to the invention and joined axially together at connections $V_1$-$V_4$. The individual longitudinal sections $T_1$-$T_4$ each have only a relatively short axial length, thus simplifying joining of the individual turns of a longitudinal section to one another at the parallel fins, i.e. by the mentioned spot welds.

FIG. 7 shows that at the ends E of the screw-tube conveyor the longitudinal edges 1*a* and 1*b* of the base strip 112 forming the base zones of the rotatable tube 110 after bending along the bend lines, —unlike the general shape of a parallelogram—are cut on a taper at an acute angle. In this manner it becomes possible for the rotatable tube 110 to end at a plane that is perpendicular to the axis of the tube. The plane ending at both ends of the screw-tube conveyor 110 enables a flange to be mounted that can preferably be connected to the fins present there that also lie on that plane. The flange 140 may be formed as a toothed gear, as shown for the left end of the screw-tube conveyor 100 shown in FIG. 7. The toothed gear can mesh with a pinion 151 for rotating the screw-tube conveyor 100. The pinion is an integral part of a drive 150 for rotating the screw-tube conveyor 100. The flange 140 may also be made as a support ring 142, as shown for the right end of the screw-tube conveyor shown in FIG. 7. Here the support ring serves for rotational support of the screw-tube conveyor 100 on rollers 160 that are preferably embodied conically. The toothed gear and the support ring are preferably concentric and coaxial and at the same radial spacing from the axis.

Figure 8:
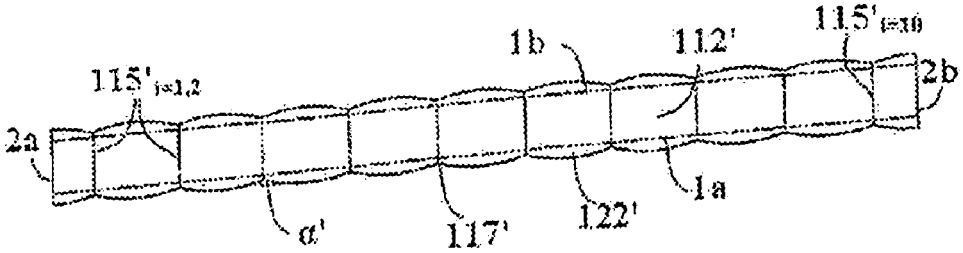
FIG. 8 shows a blank for making a screw-tube conveyor in accordance with the second embodiment.

The second embodiment according to the invention for making the screw-tube conveyor is described in further detail with reference to FIGS. 8-12 as follows. Reference is made as much as possible to analogous figures relating to the first embodiment with regard to the description of the figures, the same technical features being denoted by the same reference symbols, with the only exception that the reference symbols for the respective elements include primes in the second embodiment. The method according to the second embodiment comprises the following steps:

In a first step a unitary blank according to FIG. 8 is produced; in this regard reference is made to FIG. 2 and the related description. The only difference between the blank according to the second embodiment and the blank according to the first embodiment is that the lateral fins 122' are preferably shaped convex manner with a part-circular arc in the second embodiment relative to the first pair of longitudinal edges 1*a* and 1*b*, as indicated in FIG. 8.

In a second step the fins 122' are then bent about a fin bend angle $\gamma'$ relative to the base strip 112', preferably by 90°.

Figure 9:
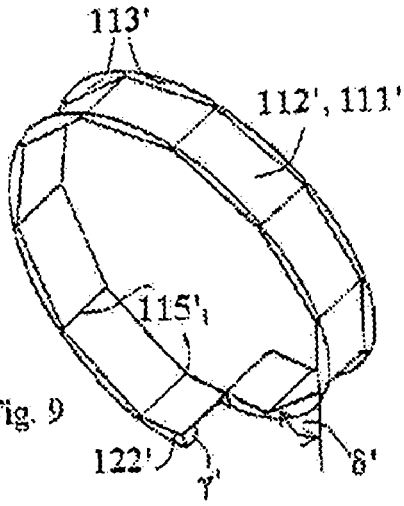
FIG. 9 shows the FIG. 8 blank having fins that are bent in accordance with the second embodiment and having a fully] bent base strip.

In a third process step the base strip 112' is then bent along the bend lines $\mathbf{115'}_i$ about a base bend angle $\delta'$ such that the base strip forms a base zones of the rotatable tube 110', as shown in FIG. 9. The previously bent fins 122' thus together form a ridge 113' projecting radially outward from the respective base zones 111'. At least one turn of the rotatable tube 110' is created by bending the base strip as described; however, a plurality of succeeding turns may also be formed as shown in FIG. 11.

Figure 10:
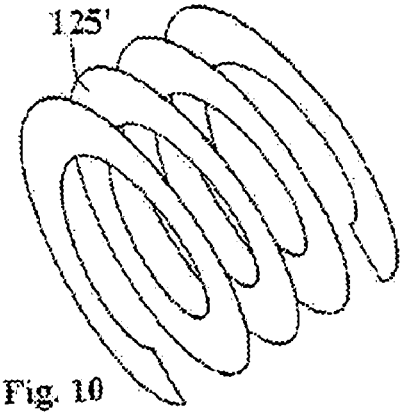
FIG. 10 shows a helical strip.
Figure 11:
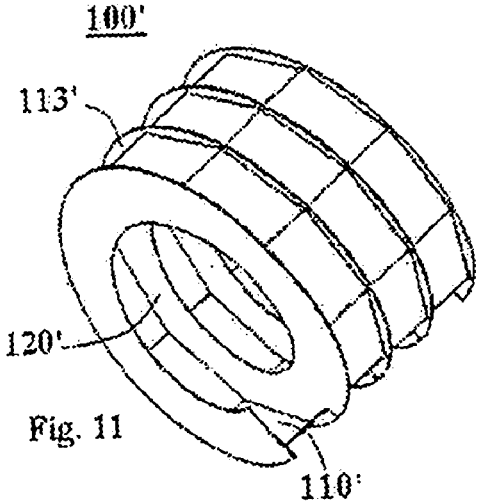
FIG. 11 shows a screw-tube conveyor assembled according to the second embodiment.

In a fourth process step according to the second embodiment the helical row of base zones 111' and a helical strip 125' shown in FIG. 10 are interleaved—as shown in FIG. 11—to form the screw-tube conveyor. The ridge 113' thus covers or overlaps the helical strip 125' at the periphery thereof, and can be joined to it at this location, preferably spot welded. Simultaneously that part of the helical strip 125' that is not covered by the ridge forms the helix 120' inside the screw-tube conveyor.

The screw-tube conveyor produced according to the second embodiment—as compared to the screw-tube conveyor produced according to the first embodiment, has the advantage that joining of the fins or of the ridge to the helical strip 125' is very easy to do because they are accessible from outside. In the screw-tube conveyor produced according to the second embodiment multiple turns of the screw-tube conveyor that are arranged next to each other can therefore be joined or produced simultaneously, while the number of turns to be joined in one working step is limited in the first embodiment due to the limited accessibility of the fins to be joined inside the screw-tube conveyor at that location.

Figure 12:
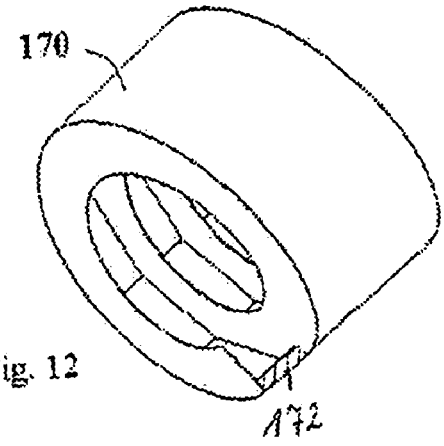
FIG. 12 shows a screw-tube conveyor according to FIG. 11 with a cylindrical housing.

For reasons of hygiene the screw-tube conveyor according to FIG. 11 can be packed, for example, in a cylindrical housing 170, see FIG. 12, thus hiding the radially outwardly projecting ridge. The housing 170 is fitted to the ridge 113', and is preferably joined to it, i.e. soldered. In this manner a helical cavity 172 is created between the housing 170, the ridge 113', and the base strip 112'. This cavity 172 is preferably evacuated, i.e. for insulation purposes; in this case a thermal treatment of the bulk material is possible inside the screw-tube conveyor in a more efficient manner. The ridge 113' supports the housing 170 against the base strip 112', even with subatmospheric pressure in the cavity 172. Soldering of the housing 170 to the ridge 113' under vacuum is also optionally possible in a simple manner. The flanges and the pinion may also be mounted to the screw-tube conveyor produced according to the second embodiment, as shown by way of example in FIG. 7 for the screw-tube conveyor produced according to the first embodiment.

The invention claimed is:

1. A method of making a screw-tube conveyor in the form of a cylindrical rotatable tube having an internal helix for conveying and mixing bulk material, the method comprising the following steps:

providing a unitary blank comprising an elongated base strip having a longitudinal row of lateral fins, the base strip having two first opposite longitudinal edges and two second transverse end edges bridging ends of the longitudinal edges, the strip having longitudinally spaced and transversely extending bend lines extending between the first longitudinal edges and extending parallel to the second transverse edges, the fins each being formed unitarily with one of the longitudinal edges between two adjacent bend lines or between one of the transverse end edges and an adjacent one of the bend lines;

bending each of the fins about a fin bend angle relative to the base strip along the one longitudinal edge at which the fins are unitarily connected to the base strip; and bending the base strip along the bend lines about a base bend angle such that the base strip forms between the bend lines a helical row of base zones of the rotatable tube and the previously bent fin forms a segment of a helix inside the rotatable tube or a ridge projecting radially outward from the helical row of base zones.

2. The method according to claim 1, further comprising the steps of:

interleaving the helical row of base zones and a helical strip such that the ridge lies against the helical strip and that an inner edge of the helical strip that is not covered by the ridge forms a helix inside the screw-tube conveyor; and joining the helical strip and the ridge in the overlapping regions into the screw-tube conveyor.

3. The method according to claim 2, further comprising the step of:

mounting the screw-tube conveyor in a cylindrical housing.

4. The method according to claim 1, wherein the fin bend angle is 90°.

5. The method according to claim 1, wherein the blank is stamped, or cut.

6. A screw-tube conveyor in the form of a cylindrical rotatable tube having an interior helix, produced according to the method according to claim 1.

7. The screw-tube conveyor according to claim 6, wherein the screw-tube conveyor has multiple turns.

8. The screw-tube conveyor according to claim 7, wherein the individual turns of the screw-tube conveyor are at least partially connected to each other in that the fins positioned next to each other inside the screw-tube conveyor are spot welded together, or parts of the helical strip and ridge that are positioned next to each other on the exterior of the screw-tube conveyor are joined together.

9. The screw-tube conveyor according to claim 7, wherein the individual turns of the screw-tube conveyor are at least partially connected to each other at a base of the screw-tube conveyor by a helical weld seam.

10. The screw-tube conveyor according to claim 6, wherein the screw-tube conveyor has an end provided with a flange welded onto the bent fins in the region of the end of the screw-tube conveyor.

11. The screw-tube conveyor according to claim 10, wherein the flange is a toothed gear at the end of the screw-tube conveyor that can mesh with a pinion driven by a drive nut for rotating the screw-tube conveyor.

12. The screw-tube conveyor according to claim 10, wherein the flange is formed as a support ring for rotatably supporting of the screw-tube conveyor on rollers that are conical.

13. The screw-tube conveyor according to claim 6, further comprising:

a cavity between a housing, the ridge and the base strip, the cavity being evacuated.

14. A blank for making a screw-tube conveyor in the form of a cylindrical rotatable tube having an interior helix, the blank comprising:

an elongated base strip having two first opposite longitudinal edges and two second transverse end edges bridging ends of the longitudinal edges, the strip being formed with longitudinally spaced and transversely extending bend lines extending transversely between the longitudinal edges and parallel to the transverse end edges; and a respective longitudinal row of fins connected unitarily to the base strip at each of the longitudinal edges between two adjacent bend lines or between one of the transverse end edges and an adjacent one of the bend lines.

15. The blank according to claim 14, wherein the base strip and the fins are coplanar before the blank is bent into the screw-tube conveyor.

16. The blank according to claim 14, wherein the blank is made of sheet metal of a thickness of 0.3-3 mm.

17. The blank according to claim 14, wherein the fins are either directly longitudinally adjacent or spaced.

18. The blank according to claim 14, wherein two adjacent fins are separated from each other by a slot extending to the respective bend line.

19. The blank according to claim 14, wherein the fins are trapezoidal.

20. The blank according to claim 19, wherein outer edges of the trapezoidal fins offset from the base strip a concave or a convex part-circular arc.

21. The blank according to claim 14, wherein the fins least partially abut one another in two adjacent turns of the screw-tube conveyor after a subsequent bending of the fins relative to the base strip, and a subsequent bending of the base strip along the bend lines.

22. The blank according to claim 14, wherein the two opposite longitudinal edges extend at an acute angle toward each other in at least one end region of the base strip forming an end of the screw-tube conveyor after the bending of the base strip along the bend lines.

* * * * *